US008752780B2

(12) United States Patent
Wu

(10) Patent No.: US 8,752,780 B2
(45) Date of Patent: Jun. 17, 2014

(54) VIBRATION REDUCTION ISOLATION METHOD FOR SHREDDERS

(75) Inventor: Chuang Wu, Jiangsu (CN)

(73) Assignee: Fellowes, Inc., Itasca, IL (US)

( * ) Notice: Subject to any disclaimer, the term of this patent is extended or adjusted under 35 U.S.C. 154(b) by 507 days.

(21) Appl. No.: 13/144,652

(22) PCT Filed: Jan. 14, 2009

(86) PCT No.: PCT/CN2009/000047
§ 371 (c)(1),
(2), (4) Date: Oct. 28, 2011

(87) PCT Pub. No.: WO2010/081250
PCT Pub. Date: Jul. 22, 2010

(65) Prior Publication Data
US 2012/0037741 A1 Feb. 16, 2012

(51) Int. Cl.

| | |
|---|---|
| ***B02C 23/00*** | (2006.01) |
| ***B02C 18/00*** | (2006.01) |
| ***B02C 18/24*** | (2006.01) |
| *B02C 18/16* | (2006.01) |

(52) U.S. Cl.
CPC ..... *B02C 18/0007* (2013.01); *B02C 2018/168* (2013.01); *B02C 2018/0046* (2013.01); *B02C 18/24* (2013.01)
USPC ..... 241/285.1; 241/100; 241/236

(58) Field of Classification Search
USPC ..... 241/100, 236, 285.1
See application file for complete search history.

(56) References Cited

U.S. PATENT DOCUMENTS

| | | | | |
|---|---|---|---|---|
| 5,035,366 | A | 7/1991 | Hashimoto et al. | |
| 7,040,559 | B2 | 5/2006 | Matlin et al. | |
| 7,311,276 | B2 | 12/2007 | Matlin et al. | |
| 7,344,096 | B2 | 3/2008 | Matlin et al. | |
| 7,445,173 | B2 * | 11/2008 | Wang | 241/236 |
| 2002/0105124 | A1 | 8/2002 | Monson et al. | |

FOREIGN PATENT DOCUMENTS

| | | | |
|---|---|---|---|
| CN | 2291212 | Y | 9/1998 |
| CN | 2838750 | Y | 11/2006 |
| CN | 200998684 | Y | 1/2008 |
| CN | 201076825 | Y | 6/2008 |

(Continued)

OTHER PUBLICATIONS

International Search Report and Written Opinion for PCT International Patent Application No. PCT/CN2009/000047, mailed Oct. 22, 2009.

(Continued)

*Primary Examiner* — Faye Francis
(74) *Attorney, Agent, or Firm* — Pillsbury Winthrop Shaw Pittman LLP

(57) ABSTRACT

A shredder comprises a shredder housing and a shredder mechanism received in the housing. The shredder mechanism includes a motor and cutter elements and enables at least one article to be shredded to be fed into the cutter elements. The motor is operable to drive the cutter elements in a shredding direction. The shredder also includes a plurality of supporting structures between the shredder mechanism and the shredder housing. The shredder housing has a plurality of support surfaces. Each of the plurality of supporting structures is engaged but not fixedly connected on a corresponding support surface, thus allowing movement of the shredder mechanism in X, Y, and Z directions. At least one motion limiter is provided to limit the relative movement between the mechanism and the housing. The shredder mechanism may be urged to a centered position. The supporting structures may reduce vibrations and noise during operation of the shredder.

12 Claims, 5 Drawing Sheets

(56) References Cited

FOREIGN PATENT DOCUMENTS

| | | | |
|---|---|---|---|
| CN | 201105230 | Y | 8/2008 |
| CN | 101259447 | Y | 9/2008 |
| JP | 10306843 | A | 11/1998 |
| JP | 2004340301 | A | 12/2004 |
| KR | 100696582 | B1 | 3/2007 |
| WO | 2010081251 | A1 | 7/2010 |

OTHER PUBLICATIONS

International Preliminary Report on Patentability for PCT International Patent Application No. PCT/CN2009/000047, mailed Mar. 14, 2011.

Chinese Office Action for Chinese Application No. 200980157194.3, issued on Apr. 23, 2013, 14 pages.

Chinese Office Action for Chinese Application No. 200980154417.0, issued Mar. 27, 2013, 14 pages.

* cited by examiner

VIBRATION REDUCTION ISOLATION METHOD FOR SHREDDERS

CROSS REFERENCE TO RELATED APPLICATIONS

This is the U.S. National Phase of PCT/CN2009/000047, filed Jan. 14, 2009, the entire contents of which is incorporated by reference herein in its entirety.

BACKGROUND

1. Field of Invention

The present invention is generally related to a shredder having a supporting structure for reducing the transmission of at least vibrations from a shredder mechanism to a housing.

2. Description of Related Art

A common type of shredder has a shredder mechanism contained within a housing and mounted atop a container. The shredder mechanism typically includes a cutting head assembly including a series of cutter elements that shred articles such as paper, CDs, DVDs, credit cards, and the like that are fed therein and discharge the shredded articles downwardly into the container. An example of such a shredder may be found, for example, in U.S. Pat. No. 7,040,559, which is herein incorporated by reference in its entirety.

During operation of the shredder (e.g., when users feed articles to be shredded into the shredder mechanism), the cutter element of the shredder mechanism are generally rotating or moving about shafts therein. Such movement or rotation may cause forces to be transferred from the shredder mechanism to the shredder housing, thereby causing vibrations or shaking of the device, as well as the possibility of noise and/or rocking, which is not desirable. Furthermore, when shredders are operated when a bin is near capacity (e.g., when bin is near being full of shredded particles), the machine may be subject to knocking and/or rocking, which is not desirable. It may be beneficial to reduce or eliminate such noise and vibrations in the working environment as they may be undesirable to one or more users.

To assist in preventing noise and vibration that affects the housing, some shredders provide devices (such as springs or elastic pads, for example) adjacent or near a connection point between the shredder mechanism (or cutting head assembly) and the housing. FIG. 6 illustrates an example of a prior art method using elastic pads 100 (shown in detail in FIG. 7) in shredders for attempting to reduce noise and vibrations. The elastic pads 100 are provided on a connection point of the shredder housing 12 and the shredder mechanism 20 to act as a buffer, for example. However, objects such as elastic pads 100 are not capable of effective absorption of movement in an X, Y, or Z direction and rotation about X, Y, and Z axes. Thus, it is still desirable to further improve upon the reduction of noise and vibration in the shredder.

SUMMARY

An aspect of the invention provides a shredder including a shredder housing having a throat for receiving at least one article to be shredded therethrough and a shredder mechanism received in the housing, the shredder mechanism including a motor and cutter elements. The shredder mechanism enables the at least one article to be shredded to be fed into the cutter elements and the motor being operable to drive the cutter elements in a shredding direction so that the cutter elements shred the at least one article fed therein into particles. Also included are a plurality of resilient supporting structures provided between the shredder mechanism and shredder housing. The shredder housing has a plurality of support surfaces, and each of the plurality of supporting structures is engaged on a corresponding support surface. The support structures are not fixedly connected to the support surfaces, thus allowing movement of the shredder mechanism in X, Y, and Z directions. At least one motion limiter is provided between the housing and the shredder mechanism, the motion limiter being constructed to limit the relative movement between the shredder mechanism and the housing in the at least the X, Y, and Z directions.

In some embodiments, the supporting structures are configured to urge the shredder mechanism to a centered position. In some embodiments, the support surfaces of the shredder housing are concave and the support structures have convex bottom surfaces engaged with the supporting surfaces. provide a clearance between the shredder mechanism and the shredder housing.

Other objects, features, and advantages of the present invention will become apparent from the following detailed description, the accompanying drawings, and the appended claims.

DETAILED DESCRIPTION OF THE PREFERRED EMBODIMENT(S)

The following embodiments are described with reference to the drawings and are not to be limiting in their scope in any manner.

Figure 1:
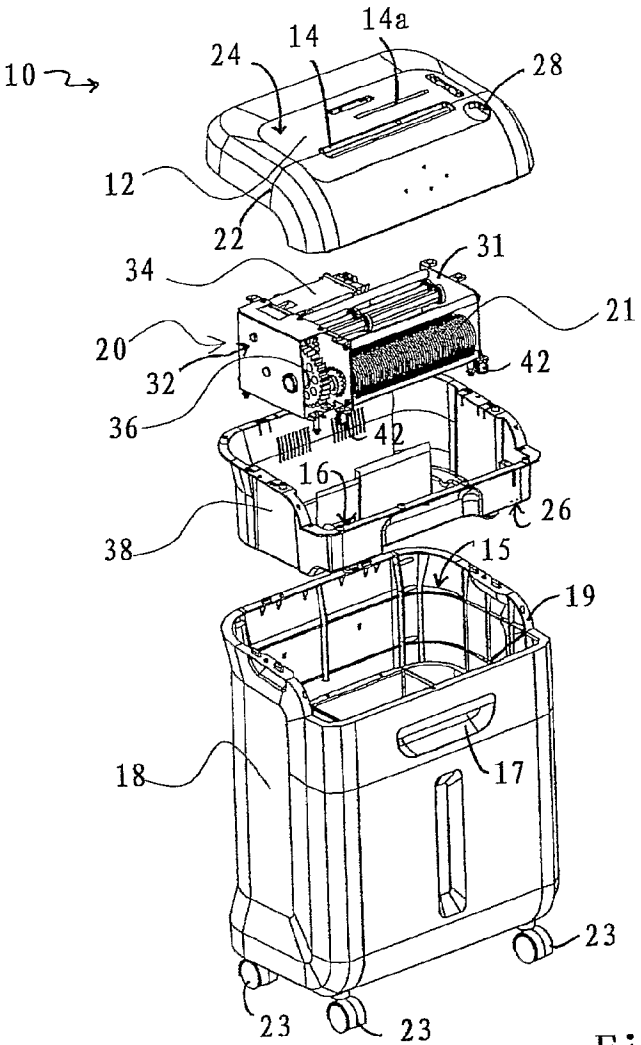
FIG. 1 is an exploded, perspective view of a shredder in accordance with an embodiment of the present invention.

FIG. 1 is a perspective view of a shredder apparatus 10 constructed in accordance with an embodiment of the present invention. The shredder 10 is designed to destroy or shred articles such as paper, paper products, CDs, DVDs, credit cards, and other objects. In an embodiment, the shredder 10 may comprise wheels 23 (such as shown in FIG. 1) to assist in moving the shredder 10. The shredder 10 comprises a shredder housing 12 that sits on top of a container 18, for example. The shredder housing 12 comprises at least one input opening 14 on an upper side 24 (or upper wall or top side or top wall) of the housing 12 for receiving materials to be shredded. The input opening 14 extends in a lateral direction, and is also often referred to as a throat. The input opening or throat 14 may extend generally parallel to and above a shredder mechanism 20 (described below). The input opening or throat 14 may be relatively narrow, so as to prevent overly thick items, such as large stacks of documents, from being fed into therein. However, the throat 14 may have any configuration.

In some cases, one or more additional or second input openings 14*a* may be provided in shredder housing 12. For example, input opening 14 may be provided to receive paper, paper products, and other items, while second input opening 14*a* may be provided to receive objects such as CDs and DVDs.

Shredder housing 12 also comprises an output opening 16 on a lower side 26 (or bottom side or bottom wall or underside or bin side). In an embodiment, shredder housing 12 may include a bottom receptacle or bottom housing 38 with lower side 26 to receive shredder mechanism 20 therein. Bottom housing 38 is affixed to the underside of the upper side 24 or top wall base fasteners, for example. The bottom housing 38 has output opening 16 in its bottom side 26 or bottom wall through which shredded particles are discharged. Though lower side 26 is shown as comprising a bottom housing 38, the configuration, shape, or design of lower side 26 or housing 38 of the shredder housing 12 should not be limiting. Bottom housing 38 is generally defined as a device part of housing 12 for at least assisting in securing the shredder mechanism 20 within and/or to the housing 12. Generally speaking, the shredder 10 may have any suitable construction or configuration and the illustrated embodiments provided herein are not intended to be limiting in any way. In addition, the term "shredder" or "shredder apparatus," used interchangeably throughout this specification, are not intended to be limited to devices that literally "shred" documents and articles, but instead intended to cover any device that destroys documents and articles in a manner that leaves such documents and articles illegible and/or useless.

As noted, the shredder 10 also comprises a shredder mechanism 20 in the shredder housing 12. When articles are inserted into the at least one input opening or throat 14, they are directed toward and into shredder mechanism 20. "Shredder mechanism" is a generic structural term to denote a device that destroys articles using at least one cutter element. For example, in some cases, a shredder mechanism may be referred to as a cutting block. Destroying may be done in any particular way. Shredder mechanism 20 includes a drive system 32 (generally shown in FIG. 1) with at least one motor 34, such as an electrically powered motor, and a plurality of cutter elements 21. The drive system 32 may have any number of motors and may include one or more transmissions 36 or gear systems. The cutter elements 21 are mounted on a pair of parallel mounting shafts (not shown). The motor 34 operates using electrical power to rotatably drive first and second rotatable shafts of the shredder mechanism 20 and their corresponding cutter elements 21 through a conventional transmission 36 so that the cutter elements 21 shred or destroy materials or articles fed therein, and, subsequently, deposit the shredded materials into opening 15 of container 18 via the output opening 16.

The shredder mechanism 20 may also include a sub-frame 31 for mounting the shafts, motor, and transmission of the drive system 32 and cutter elements 21. In some cases, the subframe 31 may be connected to both an upper side 24 (e.g., on an underside of upper side 24) and a lower side 26 (e.g., on an upper side of receptacle 38) to secure the shredder mechanism 20 within or to the housing 12. For example, one or more connecting portions 40 or supporting points are provided to secure or fasten the frame 31 of the shredder mechanism 20 to the shredder housing 12. Generally, devices such as fasteners, screws, or bolts, and nuts may be used to secure the frame 31 to the upper side 24 and lower side 26 of housing 12. However, as will be described further below with regard to FIGS. 2-5, a number of support structures 42 and at least one motion limiter 47 are used with the shredder mechanism 20 and shredder housing 12.

Also, the plurality of cutter elements 21 may be mounted on first and second rotatable shafts in any suitable manner. For example, in an embodiment, the cutter elements 21 are rotated in an interleaving relationship for shredding paper sheets and other articles fed therein. In an embodiment, the cutter elements 21 may be provided in a stacked relationship. The operation and construction of such a shredder mechanism 20 is well known and need not be discussed herein in detail. As such, the at least one input opening or throat 14 is configured to receive materials inserted therein to feed such materials through the shredder mechanism 20 and to deposit or eject the shredded materials through output opening 16.

Figure 2:
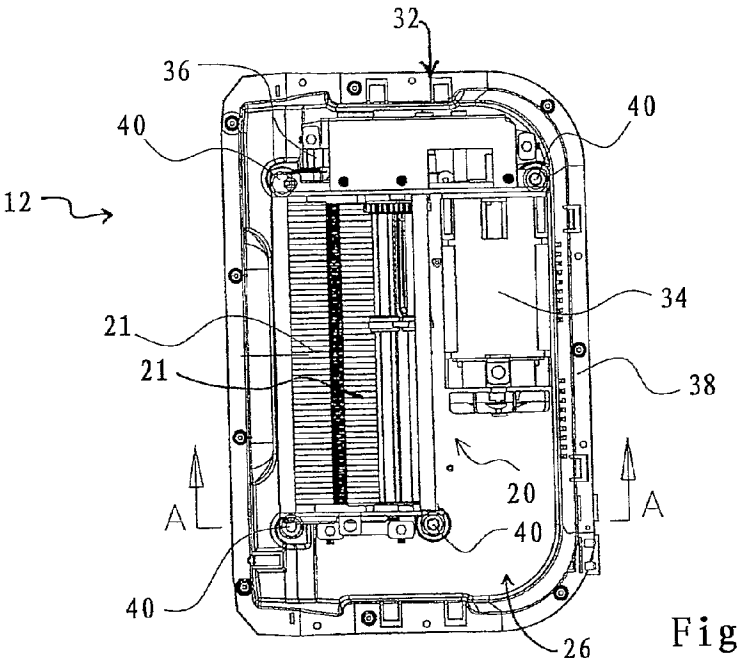
FIG. 2 is a bottom view of a shredder housing of the shredder of FIG. 1.

Shredder housing 12 is configured to be seated above or upon the container 18. As shown in FIG. 2, shredder housing 12 may comprise a detachable paper shredder mechanism. That is, in an embodiment, the shredder housing 12 may be removed in relation to the container 18 to ease or assist in emptying the container 18 of shredded materials. In an embodiment, shredder housing 12 comprises a lip 22 or other structural arrangement that corresponds in size and shape with a top edge 19 of the container 18. The container 18 receives paper or articles that are shredded by the shredder 10 within its opening 15. More specifically, after inserting materials into input opening 14 for shredding by cutter elements 21, the shredded materials or articles are deposited from the output opening 16 on the lower side 26 of the shredder housing 12 into the opening 15 of container 18. The container 18 may be a waste bin, for example.

In an embodiment, the container 18 may be positioned in a frame beneath the shredder housing 12. For example, the frame may be used to support the shredder housing 12 as well as comprise a container receiving space so that the container 18 may be removed therefrom. For example, in an embodiment, a container 18 may be provided to slide like a drawer with respect to a frame, be hingedly mounted to a frame, or comprise a step or pedal device to assist in pulling or removing it therefrom. Container 18 may comprise an opening or recess 17 to facilitate a user's ability to grasp the bin (or grasp an area approximate to recess 17), and thus provide an area for the user to easily grasp to separate the container 18 from the shredder housing 12, thereby providing access to shredded materials. The container 18 may be substantially or entirely removed from being in an operative condition with shredder housing 12 in order to empty shredded materials such as chips or strips (i.e., waste or trash) located therein. In an embodiment, the container or bin 18 may comprise one or more access openings (not shown) to allow for the deposit of articles therein.

Generally the terms "container," "waste bin," and "bin" are defined as devices for receiving shredded materials discharged from the output opening 16 of the shredder mechanism 20, and such terms are used interchangeably throughout this specification. However, such terms should not be limiting. Container 18 may have any suitable construction or configuration.

Typically, the power supply to the shredder 10 will be a standard power cord with a plug on its end (not shown) that plugs into a standard AC outlet. Also, a control panel may be provided for use with the shredder 10. Generally, the use of a control panel is known in the art. As shown in FIG. 1, an area for a power switch 28 or a plurality of switches may be provided to control operation of the shredder 10. The area for the power switch 28 may be provided on the upper side 24 of the shredder housing 12, for example, or anywhere else on the shredder 10. The upper side 24 may have a switch recess with an opening therethrough, for example. An on/off switch includes a switch module (not shown) mounted to housing 12 underneath the recess by fastening devices, and a manually engageable portion that moves laterally within recess. The switch module has a movable element (not shown) that connects to the manually engageable portion to move the switch module between its states. Movement of the manually engageable portion of switch moves the switch module between states. In the illustrated embodiment shown in FIG. 1, the switch module connects the motor 34 to the power supply. This connection may be direct or indirect, such as via a controller. The term "controller" is used to define a device or microcontroller having a central processing unit (CPU) and input/output devices that are used to monitor parameters from devices that at operatively coupled to the controller. The input/output devices also permit the CPU to communicate and control the devices (e.g., such as one or more sensors) that are operatively coupled to the controller. As is generally known in the art, the controller may optionally include any number of storage media such as memory or storage for monitoring or controlling the sensors coupled to the controller.

The controller likewise communicates with the motor 34 of the shredder mechanism 20. When a switch is moved to an on position, the controller can send an electrical signal to the drive of the motor 34 so that it rotates the cutting elements 21 of the shredder mechanism 20 in a shredding direction, thus enabling paper sheets to be fed in the throat 14 to be shredded. Additionally or alternatively, when the switch is in an on position, the switch may be set to an idle or ready position, which communicates with the control panel. The idle or ready position may correspond to selectively activating the shredder mechanism 20, for example. Such a position may allow the controller to selectively enable the operation of the shredder mechanism 20 based on the detection of the presence or insertion of at least one article (e.g., paper) in the throat 14 by or based on a waste level or bin full sensing device. The switch may also be moved to an off position, which causes the controller to stop operation of the motor 34.

The switch module contains appropriate contacts for signaling the position of the switch's manually engageable portion. As an option, the switch may also have a reverse position that signals the controller to operate the motor 34 in a reverse manner. This would be done by using a reversible motor and applying a current that is of reverse polarity relative to the on position. The capability to operate the motor 34 in a reversing manner is desirable to move the cutter elements 21 in a reversing direction for clearing jams, for example. To provide each of the noted positions, the switch 28 may be a sliding switch, a rotary switch, or a rocker switch. Also, the switch may be of the push switch type that is simply depressed to cycle the controller through a plurality of conditions. Additionally, the controller may determine that throat 14 (e.g., via one or more sensors) is not clear of articles, and, thus, operate the motor 34 in a reverse direction (e.g., for a short period of time) so as to clear any remaining articles (or parts thereof) from the throat 14 of the shredder 10.

Generally, the construction and operation of a switch and controller for controlling the motor are well known and any construction for these may be used. For example, a touch screen switch, membrane switch, or toggle switches are other examples of switches that may be used. Also, the switch need not have distinct positions corresponding to on/off/idle/reverse, and these conditions may be states selected in the controller by the operation of the switch. Any of the conditions could also be signaled by lights, on a display screen, or otherwise.

When the shredder 10 is in operation, the cutter elements 21 are rotated about their respective rotatable shafts. In some cases, the rotation or movement of the cutter elements, particularly when shredding one or more articles, may cause at least a part of the shredder mechanism 20 to move or vibrate. Such motion or forces resulting from using the shredder 10 may be transferred from the subframe 31 to the shredder housing 12, for example. In some cases, such as when the bin 18 has accumulated a sufficient amount of shredded particles therein such that it is near full or its capacity, the shredder 10 may be subject to knocking and/or rocking. Each of these reactions (vibrations, knocking, rocking, etc.) as well as the noise associated with such reactions is undesirable. As such, the shredder 10, in accordance with an embodiment, utilizes at least one support structure 42 between the shredder mechanism 20 and shredder housing 12, as better shown in FIGS. 3-5.

Figure 3:
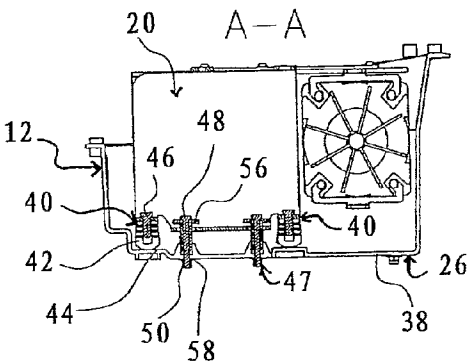
FIG. 3 is a sectional view of the shredder housing along section A-A of FIG. 2 illustrating connection points of the shredder housing and a bottom receptacle of a shredder housing of the shredder.
Figure 4:
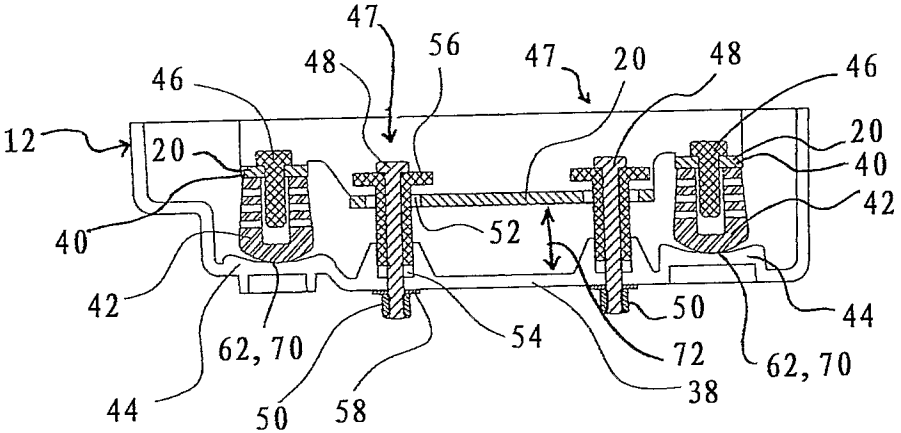
FIG. 4 is a detailed view of the sectional view of FIG. 3.

A plurality of resilient support structures 42 are provided between the shredder mechanism 20 and the shredder housing 12, as shown in FIGS. 3 and 4. The support structures 42 allow movement of the shredder mechanism 20 with respect to the shredder housing 12. More specifically, the shredder housing 12 comprises a plurality of support surfaces 44, and each of the support structures 42 are engaged on a corresponding support surface 44. The support structures 42 are not fixedly connected to the support surfaces 44, thus allowing movement of the shredder mechanism 20 in X, Y, and Z directions. In this case, the Z-direction may be defined as a vertical direction, such as a direction from a top (e.g., upper surface 24 of housing 12) to a bottom (e.g., toward wheels 23 on bin 18) of the shredder 10. The X-direction may be defined as a first horizontal direction, e.g., a direction from a right to a left side of the shredder 10, such as a lateral direction similar to that of the throat 14. The Y-direction may be defined as a second horizontal direction, e.g., a direction perpendicular to the X-direction (or throat 14), from a top to a bottom of the upper face 24 of the housing 12. However, the defined directions should not be limiting.

The support surfaces 44 and support structures 42 are configured to urge the shredder mechanism 20 to a centered position. "Centered position" may be defined as a preferred mounting position for the shredder mechanism 20 relative to the shredder housing 12. In some cases, the centered position may be provided in a substantially centered position on the support surfaces 44, for example. The support structures 42 are configured to at least reduce vibrations transmitted from the shredder mechanism 20 to the shredder housing 12 during operation of the shredder. Thus, the structures 42 act as a noise and vibrational buffers during machine operation.

Figure 5:
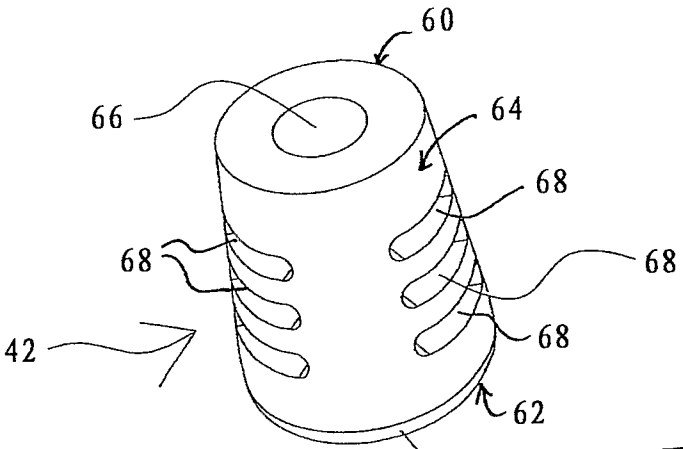
FIG. 5 is a detailed perspective view of a support structure used with the shredder in accordance with an embodiment of the present invention.
Figure 6:
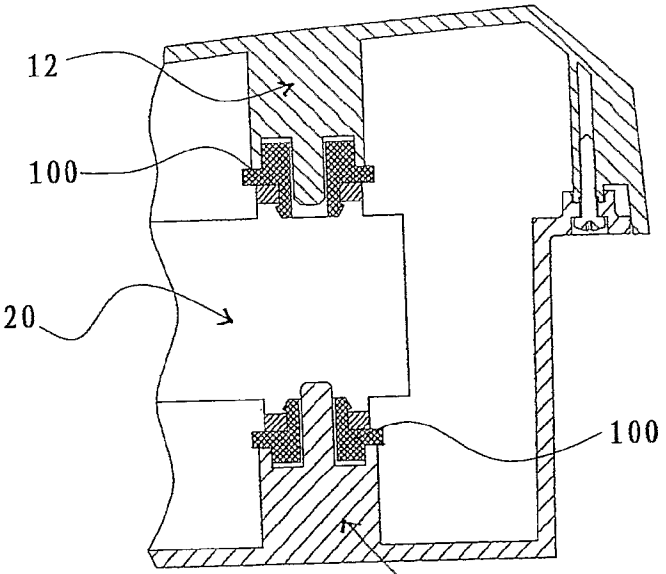
FIGS. 6-7 illustrate partial side and detailed views of the prior art.
Figure 7:
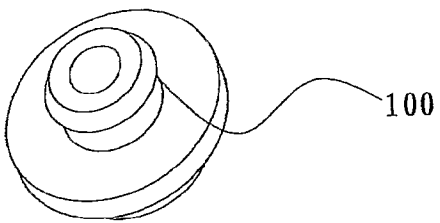

Referring more specifically to FIG. 5, in some embodiments, each of the supporting structures 42 may comprise a top part 60, bottom part 62, and a body 64. Generally, the top 60 of the structure 42 is substantially flat. The top 60 of the structure 42 is designed to contact a bottom surface of the shredder mechanism 20 when the shredder 10 is assembled, for example. The body 64 is provided between the top and bottom parts 60 and 64 and comprises a side surface. The side surface of the body 64 is generally circular or round in shape. In some cases, the body 64 may comprise a smaller diameter or radius near a top part 60 and a larger diameter or radius near a bottom part 60, thus providing a generally frusto-conical shape. The body 64 of the supporting structure 42 may comprise a guide hole or connection opening 66 that extends at least partially therethrough. For example, the opening 66 may be provided in the top 60 and extend substantially through the body 64 without extending through the bottom 62, such as shown in FIG. 4.

The body 64 may also comprise two or more hollowed slots 68 therein. A plurality of hollow slots 68 may be provided about the side surface of the body 64, for example. In some cases, a series of slots 68 may be provided on the body 64. The slots 68 may extend from an outer side surface of the body through to the connection opening 66.

As previously noted, each support structure 42 allows movement of the shredder mechanism 20 in X, Y, and Z directions with respect to the housing 12. Each support structure 42 is engaged on a corresponding support surface 44 of the housing 12, and each are not fixedly connected to the support surfaces 44 (thus allowing for such movement). In some instances, each structure 42 may comprise a surface 70 for allowing movement of the shredder mechanism 20. In some embodiments, such as shown in FIG. 5, the bottom 62 of the support structure 42 comprises the surface 70 for allowing movement in an X, Y, and Z direction, for example. Such a bottom part 62 may be substantially convex in shape and is designed to engage the support surfaces 44 of the housing 12, 38 when the shredder 10 is assembled. The shape of the surface 70 assists in absorption of forces, vibrations, etc. caused by movement in an X, Y, or Z direction and rotation about X, Y, and Z axes, as will become further evident. Specifically, in some embodiments, the surface 70 may comprise a shape substantially similar to an arc, sphere, circle, or similar types of rounded and convex surfaces. Also, the shape of the support surfaces 44 may be designed to correspond to the shape of the surface 70 of the support structures 42. For example, the support surfaces 44 may have an opposite and cooperative design, such as a concave or rounded shape, to allow for movement of the mechanism 20.

Referring back to FIGS. 1 and 2, the support structures 42 may be connected to a connecting portion 40 of the shredder mechanism 20. For example, a number of connecting portions 40 may be provided near the corners on a bottom and/or top side of the shredder mechanism, or on subframe 31 as illustrated in FIG. 1, for example. As such, a support structure 42 may be connected to one or more of the connecting portions 40 of the shredder mechanism 20, for example. As shown in FIGS. 3 and 4, when a support structure 42 is attached thereto, the shredder mechanism 20 and housing 12 (or 38) have a clearance 72 or distance therebetween. Thus, the support structures 42 assist in isolating the shredder mechanism 20 from contact with the housing 12 and 38 (or other surrounding elements) by substantially suspending the shredder mechanism 20 on top of the supporting structure 42.

More specifically, as shown in FIG. 4, a top part 60 of each of the supporting structures 42 is provided adjacent one or more connection portions 40 or supporting points provided on a bottom of the shredder mechanism 20. The supporting structures 42 are connected to the mechanism 20 using a plurality of connection bolts 46 that are inserted through the connection portion 40 and into the guide hole 66 of the support structure 42. In some embodiments, the connection bolts 46 may be separate elements that are inserted through an opening in a wall of the shredder mechanism 20 and into the support structure 42. In some embodiments, the bolts 46 may be combined or pre-attached to a wall in the shredder mechanism 20 (e.g., so that the bolt 46 is a part of the shredder mechanism and may be aligned with the structure 42 and inserted therein).

Additionally, the shredder 10 comprises at least one motion limiter 47 provided between the housing 12 and the shredder mechanism 20. The motion limiter 47 is constructed to limit the relative movement between the shredder mechanism 20 and the housing 12 in the at least X, Y, and Z directions. For example, the shredder mechanism 20 may include confined hole(s) 52 through its housing. The bottom housing 38 may include connection hole(s) 54 therethrough as well. Confined hole(s) 52 and connection hole(s) 54 may then be used with the at least one motion limiter 47 to secure and connect the shredder mechanism 20 and shredder housing 12 together and limit relative movement. The motion limiter(s) 47 may include connection bolt(s) 48 and connection nut(s) 50, for example. In an embodiment, such as shown in the Figures, the confined holes 52 may generally comprises an oversized construction in that the size (e.g., diameter, radius) of the holes 52 is relatively larger as compared to the size of the bolts 48 (e.g., the diameter or radius of a shaft of the bolt). In some cases, the confined holes 52 are larger than the connection holes 54.

To assemble the motion limiter(s) 47 in the shredder, the confined hole(s) 52 and connection hole(s) 54 are aligned and connection bolt(s) 48 are provided through hole(s) 52 and 54 and secured with connection nut(s) 50. In some cases, a blocker 56 may be provided around a shaft of the connection bolt 48. The blocker 56 acts as a limiting device to assist in limiting the movement of the cutting block/shredder mechanism 20 in transformation of the X, Y, and Z directions and rotation in the X, Y, and Z directions. The blocker 56 may limit the maximum movement of the shredder mechanism 20 in such directions, for example. The blocker 56 may be designed such that it may be insert through the confined hole 52 and into the connection hole 54. The blocker 56 may be formed from any number of materials, including, but not limited to, elastics, plastics, metal, and other materials.

In some embodiments, a cushion 58 may be provided between the connection nut 50 and bottom housing 38. The cushion 58 may be in the form of an o-ring, for example. Once fully assembled, the shredder mechanism 20 is secured to the bottom housing 38 via the bolts 48 and nuts 50 and the supporting structures 42 are between the mechanism 20 and housing 38.

Though at least a part of the shredder mechanism 20 (e.g., a bottom part or wall) and a part of the shredder housing 12 (e.g., a bottom receptacle 38) are generally described as being connected and/or stabilized with respect to each other using bolts 48 and nuts 50, it is to be understood that additional or less devices may be used to connect the shredder mechanism 20 and housing 12. For example, devices may be used to attach or connect side or top walls of the mechanism 20 and housing 12 to each other. Also, devices other than bolts 48 and nuts 50 may also be used for attachment. Thus, the assembly and/or attachment of the shredder mechanism 20 and housing 12 should not be limited to the above described embodiments.

When the shredder 10 is fully assembled and prepared for use, the supporting structures 42 allow the shredder mechanism 20 to move (e.g., in an X-, Y-, or Z-direction) during operation of the shredder 10 with a limited range of freedom. The supporting structures 42 thus are capable of absorbing vibrations and reducing noise from such motion or forces effectively. The supporting structures 42 decrease the noise caused by vibration, therefore enhancing customer and end user satisfaction when utilizing the shredder 10.

Specifically, as a result of the construction, the support structures 42 dampen vibrations transmitted to the housing 12. Because the support structures 42 are not fixed to the housing 12, they can move on the supporting surfaces 44 in both the X and Y directions in a limiting sliding or yawing (i.e., pivoting about the vertical Z-axis) manner, with little or no transmission of force to the housing 12. Likewise, the support structures 42 can lift off the supporting surfaces 44 to permit limited tilting (i.e., pivoting about an X- or Y-axis) or vertical jarring of the shredder mechanism 20 with little or no transfer of force to the housing 12. The convex shape of bottom surfaces 70 of the support structures 42 and the concave surfaces of the supporting surfaces 44 will urge the mechanism 20 back to a centered position. The slots 68 in the body 64 also allow the support structures 42 to compress resiliently to further dampen or absorb the transmission of forces in the vertical Z direction. The construction of the holes 52, bolts 48, and blocker 56 enable this movement, but only in a limited amount. Specifically, the spacing between the blocker 56 and bolt 48 flanges and the housing 12, and the oversized relationship of the holes 52 relative to the bolts 48 and blockers 56 enable limited movement in the X, Y, and Z directions, which enables such linear movement in these directions, as well as compound movements, including yawing and tilting.

Furthermore, the features of the support structure 42 provide additional advantages and improvements over the prior art. For example, the rounded and convex shaped surface 70 on the bottom 62 of the support structure 42 allows for 360 degree movement or tilting on the supporting surface 44 of the bottom receptacle 38, thereby increasing the amount of absorption provided by the support structures 42.

Also, as noted above, by forming and mounting the supporting structure 42 as described, a spacing or clearance 72 is provided between the shredder mechanism 20 from the housing 12 thereby isolating the parts from each other. Such isolation also assists in reducing or eliminating the transmission of vibrations from the shredder mechanism to the housing 12, bin 18, or other parts of the shredder 10. As such, noise is reduced and stability of the shredder is improved.

Additionally, the supporting structures 42 as described may be connected to existing connection portions 40 or attachment points in shredders. Thus, the supporting structures 42 may be used with existing shredders to thereby reduce vibrations and/or noise.

The support structure(s) 42 may be formed from several methods and materials. For example, it is envisioned in an embodiment that the structure 42 is formed via injection methods. Using an injection method provides an industrial production advantage over the prior art as the formation of the support structure 42 may be quick and easy, thereby increasing production times and decreasing costs, for example. In some instances, an elastic material may be used to form the support structure(s) 42. The elastic material may comprise a Shore A hardness of about 30 to about 90 to limit the degree of movement between the housing 12 and shredder mechanism 20. In some embodiments, the structure(s) 42 may have a Shore A hardness of about 30 to about 85. In some cases, the hardness of the elastic material or supporting structure 42 may be determined based on a weight of the shredder mechanism 20. In an embodiment, an elastic material may be injected through a tooling assembly to form the herein described or similar shape. Using an elastic material is also advantageous as it allows for substantial absorption of vibrations. However, such methods and materials for structure 42 should not be limiting. For example, forming the support structure using plastics (e.g., PVC) (see FIG. 8), metals, or other types of materials that are elastic or resilient (see FIG. 9) may also be within the scope of the invention. Also, the structure 42 may be formed to have alternate degrees or ranges of hardness to achieve the desirable effect of absorption.

Figure 8:
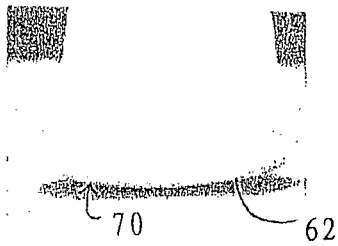
FIGS. 8 and 9 illustrate other embodiments of a support structure for use with a shredder in accordance with an embodiment of the present invention.
Figure 9:
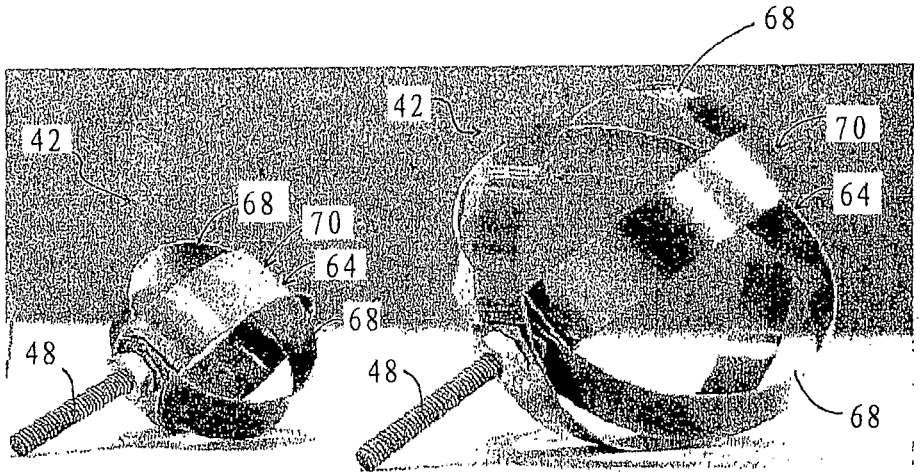

The shape and design of the support structures 42 should not be limiting. FIGS. 8 and 9 illustrate examples of other designs and materials used for forming support structures 42. Additionally, the location of the support surfaces 44 and/or surface 70 for movement should not be limiting. For example, when using support structures 42 as shown in FIG. 9, support surfaces 44 may be provided on the shredder mechanism 20. Surface(s) 70 may also be provided on the top part of the support structure 42. Generally, the design of the support structures 42 and location of the support surfaces 44 should not be limiting so as long as the shredder mechanism 20 and housing 12 are capable of relative movement and act as a buffer structure for absorbing vibrations and limiting noise. Also, the design of the support structures 42 may be formed such that the mechanism 20 and housing 12 are provided with a clearance 72 therebetween.

While the principles of the invention have been made clear in the illustrative embodiments set forth above, it will be apparent to those skilled in the art that various modifications may be made to the structure, arrangement, proportion, elements, materials, and components used in the practice of the invention.

The type of shredder 10 that the supporting structures 42 are applied to should not be limiting. For example, the supporting structures may be applied to shredders comprising lift-off shredder housings. Also, the shredder 10 may comprise a shredder mechanism 20 and cutter elements 21 of many configurations. The above mechanism may be implemented in all cross cut machines and strip cutting machines.

Additionally, one or more supporting structures 42 may be used in cooperation with one or more sensor devices in the shredder 10. Such sensor devices may be devices that are capable of, but not limited to, detecting that the bin or container 18 is full of accumulated shredded particles, detecting that the shredder mechanism should be activated (e.g., by inserting article(s) into throat 14), determining a maximum thickness (e.g., to indicate that the thickness of at least one article being inserted into the throat 14 is at least equal to a predetermined thickness), detecting movement of the container 18, detecting shredded materials located in or around the output opening 16, detecting power of the shredder 10 or whether the shredder mechanism 20 is switched on or off, and/or detecting and indicating that the output opening 16 is restricted or closed. Also, sensor devices may be used in cooperation with any number of mechanical, electromechanical, or electric devices. For example, in the case of a sensor for detecting movement of the container, if the waste container or bin 18 is removed from the shredder housing 12, the shredder mechanism 20 will not operate.

In some embodiments, any number of visual or audible signals in the form of lights or alarms, for example, may be used in cooperation with the shredder. For example, it is envisioned that such signals may be used under circumstances such as indicating that the bin is full. Any suitable indicator may be used.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a shredder housing having a throat for receiving at least one article to be shredded therethrough;

a shredder mechanism received in the housing, the shredder mechanism including a motor and cutter elements, the shredder mechanism enabling the at least one article to be shredded to be fed into the cutter elements and the motor being operable to drive the cutter elements in a shredding direction so that the cutter elements shred the at least one article fed therein into particles;

a plurality of resilient supporting structures provided between the shredder mechanism and shredder housing;

the shredder housing comprising a plurality of support surfaces, each of the plurality of supporting structures being engaged on a corresponding support surface, wherein the support structures are not fixedly connected to the support surfaces, thus allowing movement of the shredder mechanism in X, Y, and Z directions, and at least one motion limiter provided between the housing and the shredder mechanism, the motion limiter being constructed to limit the relative movement between the shredder mechanism and the housing in the at least the X, Y, and Z directions.

2. A shredder according to claim 1, wherein the support surfaces and the supporting structures are configured to urge the shredder mechanism to a centered position.

3. A shredder according to claim 2, wherein the support surfaces are concave and wherein the support structures have convex bottom surfaces engaged with the supporting surfaces.

4. A shredder according to claim 1, wherein the plurality of supporting structures are configured to provide a clearance between the shredder mechanism and the shredder housing.

5. A shredder according to claim 1, wherein each of the supporting structures comprise a connection opening, the connection opening being provided through a center of the supporting structure and extending partially through the supporting structure.

6. A shredder according to claim 3, wherein the convex bottom surfaces comprise a shape selected from the group consisting of: circular, arc, or sphere.

7. A shredder according to claim 1, wherein each of the plurality of supporting structures further comprise two or more hollowed slots in a body of the supporting structure.

8. A shredder according to claim 1, wherein the at least one supporting structure is formed from an elastic material.

9. A shredder according to claim 8, wherein the at least one supporting structure comprises a Shore A hardness of about 35 to about 90.

10. A shredder according to claim 8, wherein a hardness of the elastic material of the supporting structure is based on a weight of the shredder mechanism.

11. A shredder according to claim 1, further including a plurality of connection bolts configured to connect the shredder mechanism and the support structures.

12. A shredder according to claim 11, wherein the connection bolts are attached to the shredder mechanism.

* * * * *